US010145065B2

(12) United States Patent
Grohmann et al.

(10) Patent No.: US 10,145,065 B2
(45) Date of Patent: Dec. 4, 2018

(54) ROLL COVER

(71) Applicant: VOITH PATENT GMBH, Heidenheim (DE)

(72) Inventors: Franz Grohmann, Payerbach (AT); Martin Breineder, Natschbach (AT); Thomas Breineder, Natschbach (AT)

(73) Assignee: Voith Patent GmbH, Heidenheim (DE)

( * ) Notice: Subject to any disclaimer, the term of this patent is extended or adjusted under 35 U.S.C. 154(b) by 981 days.

(21) Appl. No.: 14/389,421

(22) PCT Filed: Mar. 22, 2013

(86) PCT No.: PCT/EP2013/056077
§ 371 (c)(1),
(2) Date: Sep. 30, 2014

(87) PCT Pub. No.: WO2013/144015
PCT Pub. Date: Oct. 3, 2013

(65) Prior Publication Data

US 2015/0090133 A1 Apr. 2, 2015

(30) Foreign Application Priority Data

Mar. 30, 2012 (DE) ..... 10 2012 205 206

(51) Int. Cl.
*D21G 1/02* (2006.01)
*D21F 3/08* (2006.01)

(52) U.S. Cl.
CPC ..... *D21G 1/0246* (2013.01); *D21F 3/08* (2013.01); *D21G 1/0233* (2013.01)

(58) Field of Classification Search
CPC ..... D21G 1/02; D21G 1/0246; D21G 1/0233; D21F 3/08
USPC ..... 492/20, 48, 50, 53, 56, 59
See application file for complete search history.

(56) References Cited

U.S. PATENT DOCUMENTS

| | | | | |
|---|---|---|---|---|
| 3,724,047 | A * | 4/1973 | Peterson | B41N 7/06 101/348 |
| 4,989,306 | A * | 2/1991 | Leino | C23C 4/06 492/58 |
| 5,167,068 | A | 12/1992 | Leino et al. | |
| 5,387,172 | A | 2/1995 | Habenicht et al. | |
| 6,375,602 | B1 * | 4/2002 | Jones | D21G 1/024 492/50 |
| 6,409,645 | B1 * | 6/2002 | Paasonen | D21F 3/08 101/375 |
| 7,736,468 | B2 * | 6/2010 | Li | D21F 3/0227 162/358.4 |
| 8,282,785 | B2 * | 10/2012 | Ajoviita | D21G 1/0233 100/155 R |
| 9,290,887 | B2 * | 3/2016 | Putschoegl | D21H 23/58 |
| 2003/0129411 | A1 * | 7/2003 | Saito | C08G 59/50 428/413 |
| 2005/0082720 | A1 * | 4/2005 | Bloom | B29C 43/003 264/319 |
| 2015/0148206 | A1 * | 5/2015 | Bischof | D21G 1/0233 492/20 |

FOREIGN PATENT DOCUMENTS

| | | | |
|---|---|---|---|
| AT | 502579 | A1 | 4/2007 |
| CN | 1037371 | A | 11/1989 |
| DE | 102005002639 | A1 | 7/2006 |
| DE | 102009029045 | A1 | 3/2011 |
| DE | 102009029695 | A1 | 3/2011 |
| EP | 0582950 | A1 | 2/1994 |
| EP | 1612329 | B1 | 6/2009 |
| WO | 2011035969 | A1 | 3/2011 |

* cited by examiner

*Primary Examiner* — Jason L Vaughan
(74) *Attorney, Agent, or Firm* — Laurence A. Greenberg; Werner H. Stemer; Ralph E. Locher

(57) ABSTRACT

A roll cover is particular suited for use in an apparatus for producing or surface finishing a fibrous web, such as a web of paper or of cardboard. The roll cover is formed on a roll core of metal or of a fiber-reinforced plastic and includes a matrix system wherein fillers are provided. The fillers provided are three or more in number and they have different median particle sizes.

16 Claims, No Drawings

ROLL COVER

BACKGROUND OF THE INVENTION

Field of the Invention

The invention proceeds from a roll cover, in particular for use in calendars and calendaring units, for producing or surface finishing a fibrous web such as a web of paper or of cardboard, wherein the roll cover is formed on a roll core of metal or of a fiber-reinforced plastic and includes a matrix system with fillers.

The use of fiber-reinforced and filled epoxy resins for calendar covers and other abrasion-resistant roll covers for application in the paper industry and similar applications is well-established prior art.

European patent specification EP 1 612 329 B1, for example, discloses the use of nanoparticles alone or combined with larger particles to modulate and adapt certain properties of the roll cover such as its abrasion resistance and its compressive modulus (determined to EN ISO 604: 2003 point 3.6, for example) to the particular requirements in the selected roll position.

The proportions of fillers used are always a compromise between the various requirements of the roll cover. A very high fill level is desirable to achieve a very high abrasion resistance and the desired high compressive modulus.

However, the surface roughness which comes about in use limits in particular the amount of hard, abrasion-resistant fillers in a particle size >0.5 μm or the resulting surface is excessively rough and has an adverse effect on the desired calendaring of the paper.

Furthermore, there are certain limits where an increasing filler content will lead to an increasing embrittlement of the material and hence to an increasing risk of massive damage in the event of local overloading or thermal stresses.

BRIEF SUMMARY OF THE INVENTION

The problem addressed by the present invention is therefore that of remedying the known disadvantages of the prior art and of specifying a roll cover which combines not only a high compressive modulus but also good abrasion resistance with low surface roughness in operation and very low brittleness.

The problem is solved by the characterizing features as claimed in combination with the generic features.

The invention accordingly provides that the fillers present are at least three in number and each have different median particle sizes.

The at least threefold combination of various mineral fillers or of synthetically produced hard materials with different median particle sizes provides a high level of abrasion resistance coupled with low surface roughness in use and high mechanical and thermal resistance.

Further advantageous aspects and embodiments of the invention will be apparent from the dependent claims.

Advantageously, a first filler may have a median particle size in the range from 1 to 100 nm, preferably from 5 to 50 nm and more preferably from 10 to 30 nm. This provides a high resistance to cracking and an increase in the compressive modulus.

A second filler may have a median particle size in the range from 50 to 2000 nm, preferably from 100 to 500 nm and more preferably from 100 to 300 nm and advantageously performs a bridging function between large and small fillers. It reduces the erosion of the resin matrix at the free surface between the large fillers.

A third filler may have a median particle size in the range from 0.5 to 15 μm, preferably from 1 to 7 μm and more preferably from 2 to 4 μm and hence effect a further increase in the compressive modulus and also an increase in the abrasion resistance.

In advantageous aspects of the invention, the particle size distributions of the at least three fillers may be selected to be overlapping or nonoverlapping. This may further influence the property profile of the roll cover.

In a further advantageous aspect of the invention, at least two of the fillers, especially three of the fillers may be chemically identical.

Alternatively, the at least three fillers may be different. This enables choice from a broad selection of suitable fillers that are commercially available in the particle sizes needed in each case and the utilization of intentionally different properties (high hardness and good matrix attachment, for example) and morphologies (an example being spherical particles of high abrasion resistance in order to achieve same as well as low surface roughness in use, or rod- or fiber-shaped fillers in order to achieve structural reinforcement) to optimize the overall system.

Preferably, at least the second and/or third filler may be selected from: oxides, carbides, nitrides, aluminosilicates, silicates of mineral or synthetic origin or mixtures thereof. These possess a high level of hardness and abrasion resistance and are commercially available in many different forms.

In an advantageous aspect of the invention, the first filler may be selected from: oxides, carbides, nitrides, aluminosilicates, silicates, sulfates, carbonates, phosphates, titanates, carbonanotubes, carbonanofibers, metals of mineral or synthetic origin or mixtures thereof.

It is particularly preferable for the fillers, in particular the first filler, to be surface-modified fillers, which makes for better attachment to the resin matrix.

In an advantageous aspect of the invention, the level of fillers in the matrix system may be between 0.5 and 30 volume percent. This value represents a good middle course for the maximum attainable abrasion resistance given the required elasticity.

Advantageously, the level of first filler is from 0.5 to 20 volume percent, preferably from 1.5 to 15 volume percent, while the level of second filler is from 0.5 to 5 volume percent, preferably from 1 to 3 volume percent, and the level of third filler is from 0.5 to 20 volume percent, preferably from 3 to 15 volume percent.

Preferably, the matrix system may be a thermoset, in particular an amine- or anhydride-crosslinked or self-crosslinking epoxy resin or an isocyanate ester or a mixture thereof. Resin systems of this type are commercially available in large bandwidth and may each be selected according to the requirements.

DESCRIPTION OF THE INVENTION

The invention will now be more particularly described.

Calendars or calendaring units for fibrous webs such as webs of paper or of board have the office to calendar the fibrous web either directly following its production (online) or else at a later date (offline). To discharge this office, the covers on the rolls in a calendar have to meet very high requirements with regard to both their surface finish and their resistance to thermal and mechanical stresses.

It is customary for a calendar to have two or more rolls arranged in the form of a stack, one common embodiment of which has a metallic heatable roll paired with an unheated resilient roll to form a nip. Initially, a first side of the fibrous web is calendared under heat and pressure in two or more successive nips. A supercalendar or multinip calendar will usually have a so-called reversing nip located roughly in the middle of the stack, whereafter the other side of the fibrous web comes into contact with the calendaring hot rolls. This constellation immediately dictates the need to make the roll surface of the unheated resilient rolls as smooth as possible in order that the previously already achieved calendaring outcome on the fibrous web may not be undone.

The roll covers of unheated rolls usually consist of one or more or else often of two or more layers of diverse materials such as rubber, polyurethane or fiber-reinforced plastics applied to a roll body. Fiber-reinforced plastics are usually the material of choice for application in a calendar, since they possess a high level of thermal resistance and also a high level of mechanical strength and a good level of abrasion resistance.

Fiber-reinforced plastics usually comprise a matrix system of a resin and also an embedded fibrous reinforcement of glass, carbon or aramid fibers or similar other suitable fibers as reinforcement. The production of roll covers of this type is well known, so only a short summary will be provided here.

Production may proceed in accordance with diverse existing processes. One possibility is to wind the fibers dry and to apply the matrix by casting. Another common process provides that fiber bundles, known as rovings, be pulled through a resin bath comprising the resin matrix and then be wound up wet onto the roll body. Injection-molding processes wherein the matrix material is applied to a rotating roll body via axially displaceable dies are also known and suitable for producing a roll cover of the present invention.

Construction may be single- or multi-layered, while further layers such as, for example, a base layer, designed to provide adherence between the roll core and the roll cover, and additional tie-layers may also be provided. The measures of the present invention relate to a roll cover functional layer that contacts the fibrous web.

Useful matrix systems include amine-crosslinked, anhydride-crosslinked or else self-crosslinking epoxy resins, isocyanate esters or other thermosets or mixtures thereof.

Whichever method is used, it is possible and customary to fill the resin matrix with fillers to thereby improve its mechanical and thermal properties.

The combination with two fillers with different median particle sizes in the resin matrix is already prior art. There is practical proof of the feasibility and also the positive effects of such combinations, but the performance of roll covers thus engineered leaves something to be desired.

The invention thus provides that at least one further filler be incorporated in the resin matrix.

The combination of at least three fillers that vary in relation to the median particle size and have distinctly different average particle sizes makes optimal use of the synergies between the individual fillers.

One component is referred to hereinbelow as the first filler, has a particle size in the range between 1 to 100 nanometers, works as a crack stopper and effects an associated increase in the mechanical strength and also an increase in the compressive modulus. The prerequisite for this is good bonding to the matrix and a uniform distribution of the particles in the matrix. The increased compressive modulus has the effect that a calendar, the wear mechanism of which is essentially pressure-induced, will incur the onset of severe wear at a distinctly later date, since the degree of deformation and hence the stresses which arise are reduced.

One component, which is referred to hereinbelow as the third filler and is also referred to as "large" hard material, has an average particle size in the single-digit to low two-digit micrometer range, enhances primarily the resistance to abrasive wear and leads to a further increase in the compressive modulus.

A further component provided is referred to as the second filler and has medium-size particle sizes on the order of 0.1 to 1 micrometer. The second filler performs a bridging function between the two other fillers and inter alia reduces the matrix erosion by particles coming from the fibrous web or the coating medium and forced in between the "large" hard materials.

A comparable effect is very difficult if not impossible to reproduce with particularly broad particle size distributions of one filler, since particles having such broad particle size distributions will almost always exhibit appreciable fluctuations between the particle size distributions of individual batches.

Table 1 shows the median particle sizes and the possible particle size distributions of fillers and the respective fill level.

TABLE 1

| | First filler Nanoscale fillers | Second filler Submicronscale fillers | Third filler Micronscale fillers |
|---|---|---|---|
| Volume fractions in epoxy matrix | 0.5-20% | 0.5-5% | 0.5-20% |
| Preferred vol. % | 1.5-15% | 1-3% | 3-15% |
| Median particle size | 1-100 nm | 50-2000 nm | 0.5-15 μm |
| Preferred median particle size | 5-50 nm | 100-500 nm | 1-7 μm |
| Particularly preferred median particle size | 10-30 nm | 100-300 nm | 2-4 μm |

The materials for the third filler preferably come from a first group comprising oxides, carbides, nitrides, aluminosilicates, silicates of mineral or synthetic origin or else glass spheres or mixtures thereof.

Possible materials for the first filler include the materials from the first group, but also from a second group comprising sulfates, carbonates, phosphates, titanates, carbonanotubes, carbonanofibers, metals of mineral or synthetic origin or mixtures thereof.

The material for the second filler may be chosen from both groups. Preferably, the second and third fillers are selected from the same group, more preferably from the first group.

The first filler may be used with or without surface modification, for example with poly-L-lactide-coated $SiO_2$ for better attachment to the matrix.

Optimum composition depends not only on the specifically selected fillers, their particle size distribution and morphology but also on the desired hardness/compressive modulus and the necessary surface roughness in operation.

The three fillers may be chosen from a broad selection of suitable components commercially available in the particular particle sizes needed. The selection may be used to emphasize intentionally different properties, for example a high level of hardness and a good level of attachment to the matrix.

The morphologies of the three fillers may likewise be chosen from a broad spectrum. For instance, spherical particles such as, for example, glass spheres of high abrasion resistance are sensible and possible to achieve high hardness coupled with low surface roughness resulting in operation. Rod- or fiber-shaped fillers such as carbonanotubes can be used for structural reinforcement and for optimizing the overall system.

The three fillers may preferably form a very homogeneous distribution in any one layer. However, it is also possible to modify the above-described methods of application in a suitable way to achieve gradients within said layer or intentional incremental changes.

The invention claimed is:

1. A roll cover assembly, comprising:

a roll cover formed on a roll core of metal or of a fiber-reinforced plastic, said roll cover being formed of a fiber-reinforced plastic including a matrix system with fillers in said matrix;

said fillers being at least three in number and said fillers having distinctly different median particle sizes, with a first filler material having a median particle size in a range from 1 to 100 nm, a second filler material having a median particle size in a range from 50 to 2000 nm, and a third filler material having a median particle size in a range from 0.5 to 15 μm.

2. The roll cover assembly according to claim 1, configured for use in an apparatus for producing or surface finishing a fibrous web selected from the group consisting of paper and board.

3. The roll cover assembly according to claim 2, wherein said first filler material is selected from the group consisting of oxides, carbides, nitrides, alumino-silicates, silicates, sulfates, carbonates, phosphates, titanates, carbonanotubes, carbonanofibers, metals of mineral or synthetic origin and mixtures thereof.

4. The roll cover assembly according to claim 3, wherein said first filler material is a surface-modified filler.

5. The roll cover assembly according to claim 1, wherein:

said first filler material has a median particle size in a range from 5 to 50 nm;

said second filler material has a median particle size in a range from 100 to 500 nm; and said third filler material has a median particle size in a range from 1 to 7 μm.

6. The roll cover assembly according to claim 1, wherein:

said first filler material has a median particle size in a range from 10 to 30 nm;

said second filler material has a median particle size in a range from 100 to 300 nm; and said third filler material has a median particle size in a range from 2 to 4 μm.

7. The roll cover assembly according to claim 1, wherein said at least three fillers have particle size distributions that are overlapping or non-overlapping.

8. The roll cover assembly according to claim 1, wherein at least two of said fillers are of an identical material.

9. The roll cover assembly according to claim 1, wherein said at least three fillers are formed of a different material.

10. The roll cover assembly according to claim 1, wherein at least said second filler material and/or said third filler material of said at least three fillers is selected from the group consisting of: oxides, carbides, nitrides, aluminosilicates, silicates of mineral or synthetic origin and mixtures thereof.

11. The roll cover assembly according to claim 1, wherein a content of said at least three fillers in said matrix system lies between 0.5 and 30 volume percent.

12. The roll cover assembly according to claim 11, wherein the content of said first filler material lies between 0.5 and 20 volume percent.

13. The roll cover assembly according to claim 11, wherein the content of said second filler material lies between 0.5 and 5 volume percent.

14. The roll cover assembly according to claim 11, wherein the content of said third filler material lies between 0.5 and 20 volume percent.

15. The roll cover assembly according to claim 11, wherein the content of said first filler material lies between 1.5 and 15 volume percent, the content of said second filler material lies between 1 and 3 volume percent; and the content of said third filler material lies between 3 and 15 volume percent.

16. The roll cover assembly according to claim 1, wherein said matrix system is a thermoset selected from an amine- or anhydride-crosslinked or self-crosslinking epoxy resin or an isocyanate ester or a mixture thereof.

* * * * *